US008782991B2

(12) United States Patent
Schwartau

(10) Patent No.: US 8,782,991 B2
(45) Date of Patent: Jul. 22, 2014

(54) BUILDING ROOF STRUCTURE HAVING A ROUND CORNER

(75) Inventor: Ulrich Schwartau, Port d Andratx (ES)

(73) Assignee: Millport Associates S.A., Panama (PA)

( * ) Notice: Subject to any disclaimer, the term of this patent is extended or adjusted under 35 U.S.C. 154(b) by 0 days.

(21) Appl. No.: 12/170,720

(22) Filed: Jul. 10, 2008

(65) Prior Publication Data

US 2010/0005732 A1 Jan. 14, 2010

(51) Int. Cl.
*E04C 2/00* (2006.01)

(52) U.S. Cl.
USPC ..... 52/631; 52/91.1; 52/96; 52/97; 52/794.1

(58) Field of Classification Search
USPC ..... 52/631, 91.1, 96, 97, 794.1
See application file for complete search history.

(56) References Cited

U.S. PATENT DOCUMENTS

| | | | | |
|---|---|---|---|---|
| 183,160 | A | | 10/1876 | Haughian et al. |
| 1,377,891 | A | | 5/1921 | Knight et al. |
| 1,664,867 | A | | 4/1928 | Strand |
| 1,671,084 | A | * | 5/1928 | Meyercord ..... 52/631 |
| 2,120,200 | A | | 6/1938 | Davis |
| 2,142,771 | A | * | 1/1939 | Alexander ..... 52/631 |
| 2,181,164 | A | * | 11/1939 | Alexander ..... 52/631 |
| 2,230,628 | A | | 2/1941 | Sahlberg et al. |
| 2,255,151 | A | | 9/1941 | Clements |
| 3,079,649 | A | | 3/1963 | Willatts |
| 3,082,726 | A | | 3/1963 | Dosker |
| 3,112,043 | A | | 11/1963 | Tucker |
| 3,117,902 | A | | 1/1964 | Holzheimer |
| 3,170,269 | A | | 2/1965 | Dunnington |
| 3,256,666 | A | | 6/1966 | Farmer |
| 3,301,732 | A | | 1/1967 | Kunz |
| 3,388,514 | A | | 6/1968 | Archinal et al. |
| 3,425,889 | A | * | 2/1969 | Willits, Jr. ..... 248/220.43 |
| 3,436,881 | A | | 4/1969 | Schlecht |
| 3,440,790 | A | * | 4/1969 | Nerem ..... 52/631 |
| 3,462,897 | A | * | 8/1969 | Weinrott ..... 52/169.14 |
| 3,562,973 | A | | 2/1971 | Gangemi |
| 3,590,540 | A | | 7/1971 | Johnson et al. |

(Continued)

FOREIGN PATENT DOCUMENTS

| | | | |
|---|---|---|---|
| DE | 1609457 | A1 | 7/1970 |
| DE | 29 14 576 | A1 | 10/1979 |

(Continued)

OTHER PUBLICATIONS

International Search Report Corresponding to PCT/EP2007/002591, mailed Jun. 22, 2007.

(Continued)

*Primary Examiner* — Robert Canfield
*Assistant Examiner* — Babajide Demuren
(74) *Attorney, Agent, or Firm* — Renner, Otto, Boisselle & Sklar, LLP

(57) ABSTRACT

A roof structure may be made with one or more sandwich panels having a round corner and installed with a drainage slope (e.g., 5-10 degree) to facilitate removal of liquid (e.g., water, rain, snow, sleet, etc.) from the roof structure. The round corner may have any desired curvature and/or angle for establishing a drainage area. A bonding material may be used to secure and/or seal the underlying interface of the round corner. The roof structure may be secured to an exterior wall by the bonding material.

13 Claims, 4 Drawing Sheets

(56) References Cited

U.S. PATENT DOCUMENTS

| | | | | |
|---|---|---|---|---|
| 3,646,720 | A | 3/1972 | Watts | |
| 3,708,385 | A | 1/1973 | Immethun | |
| 3,791,910 | A | 2/1974 | Bowser | |
| 3,866,381 | A | 2/1975 | Eschbach et al. | |
| 3,909,995 | A * | 10/1975 | Bainter et al. | 52/79.1 |
| 3,911,554 | A * | 10/1975 | Ford | 29/527.2 |
| 3,949,532 | A | 4/1976 | Jonsson et al. | |
| 3,969,868 | A * | 7/1976 | Bainter et al. | 428/201 |
| 4,021,982 | A | 5/1977 | Kotcharian | |
| 4,024,684 | A * | 5/1977 | Holmgren | 52/127.2 |
| 4,050,609 | A | 9/1977 | Okamoto et al. | |
| 4,074,489 | A | 2/1978 | Eckel | |
| 4,074,498 | A | 2/1978 | Keller et al. | |
| 4,176,504 | A | 12/1979 | Huggins | |
| 4,177,306 | A | 12/1979 | Schulz et al. | |
| 4,199,909 | A | 4/1980 | Kotcharian | |
| 4,336,090 | A | 6/1982 | Hilton | |
| 4,373,304 | A | 2/1983 | Howitt | |
| 4,402,170 | A * | 9/1983 | Seidner | 52/631 |
| 4,435,928 | A | 3/1984 | Huling, III | |
| 4,696,137 | A | 9/1987 | Schleich | |
| 4,704,837 | A * | 11/1987 | Menchetti et al. | 52/631 |
| 4,852,310 | A | 8/1989 | Henley et al. | |
| 4,917,747 | A | 4/1990 | Chin et al. | |
| 4,936,069 | A | 6/1990 | Hunter et al. | |
| 5,100,713 | A | 3/1992 | Homma et al. | |
| 5,129,628 | A | 7/1992 | Vesper | |
| 5,274,974 | A | 1/1994 | Haag | |
| 5,277,002 | A | 1/1994 | Haag | |
| 5,285,616 | A | 2/1994 | Tripp | |
| 5,310,594 | A | 5/1994 | Holland et al. | |
| 5,349,796 | A | 9/1994 | Meyerson | |
| 5,509,242 | A | 4/1996 | Rechsteiner et al. | |
| 5,535,556 | A | 7/1996 | Hughes, Jr. | |
| 5,557,904 | A * | 9/1996 | Dahowski | 52/631 |
| 5,625,996 | A | 5/1997 | Bechtel | |
| 5,652,039 | A * | 7/1997 | Tremain et al. | 428/121 |
| 5,653,080 | A | 8/1997 | Bergeron | |
| 5,743,056 | A | 4/1998 | Balla-Goddard et al. | |
| 5,771,549 | A | 6/1998 | Saaf | |
| 5,824,382 | A * | 10/1998 | Ruby | 428/56 |
| 5,826,396 | A * | 10/1998 | Michaels | 52/631 |
| 5,834,082 | A | 11/1998 | Day | |
| 5,966,894 | A | 10/1999 | Crump, Jr. | |
| 5,974,760 | A | 11/1999 | Tingley | |
| 6,050,208 | A | 4/2000 | Kennedy | |
| 6,065,259 | A | 5/2000 | Clear | |
| 6,085,469 | A | 7/2000 | Wolfe | |
| 6,125,602 | A * | 10/2000 | Freiborg et al. | 52/560 |
| 6,158,183 | A | 12/2000 | Snell | |
| 6,176,637 | B1 | 1/2001 | Hatlan et al. | |
| 6,253,530 | B1 * | 7/2001 | Price et al. | 52/793.1 |
| 6,256,960 | B1 | 7/2001 | Babcock et al. | |
| 6,279,287 | B1 | 8/2001 | Meadows | |
| 6,295,786 | B1 * | 10/2001 | Lee | 52/745.19 |
| 6,298,619 | B1 | 10/2001 | Davie | |
| 6,305,142 | B1 | 10/2001 | Brisson et al. | |
| 6,412,247 | B1 | 7/2002 | Menchetti et al. | |
| 6,446,412 | B2 | 9/2002 | Mathis | |
| 6,565,942 | B2 | 5/2003 | Anderson et al. | |
| 6,584,740 | B2 | 7/2003 | Record | |
| 6,591,557 | B1 | 7/2003 | Thomsen et al. | |
| 6,604,328 | B1 | 8/2003 | Paddock | |
| 6,619,007 | B1 * | 9/2003 | Riesmeier | 52/631 |
| 6,627,018 | B1 | 9/2003 | O'Neill et al. | |
| 6,672,014 | B1 | 1/2004 | Jones | |
| 6,706,406 | B1 | 3/2004 | Kennedy | |
| 6,758,017 | B2 | 7/2004 | Young | |
| 6,941,720 | B2 * | 9/2005 | DeFord et al. | 52/783.14 |
| 6,948,287 | B2 | 9/2005 | Korn | |
| 7,021,014 | B1 | 4/2006 | Wolfe | |
| 7,056,567 | B2 | 6/2006 | O'Neill et al. | |
| 7,062,885 | B1 | 6/2006 | Dickenson, Jr. | |
| 7,127,865 | B2 | 10/2006 | Douglas | |
| 7,225,596 | B2 | 6/2007 | Wrass | |
| 7,238,409 | B1 | 7/2007 | Peterson et al. | |
| 7,371,304 | B2 | 5/2008 | Christman et al. | |
| 7,448,172 | B1 | 11/2008 | Knodel | |
| 7,509,776 | B2 | 3/2009 | Reisman | |
| 7,581,366 | B2 | 9/2009 | Smith et al. | |
| 7,779,600 | B1 | 8/2010 | Saebi | |
| 7,836,641 | B2 | 11/2010 | Back et al. | |
| 7,997,037 | B2 | 8/2011 | Crandell et al. | |
| 7,997,044 | B2 | 8/2011 | Green et al. | |
| 8,016,230 | B2 | 9/2011 | Fogarty et al. | |
| 8,061,105 | B2 | 11/2011 | Haga | |
| 8,065,841 | B2 | 11/2011 | Antonic | |
| 8,142,879 | B2 | 3/2012 | Whitaker et al. | |
| 8,291,655 | B2 | 10/2012 | McGlothlin | |
| 8,470,425 | B2 | 6/2013 | Day et al. | |
| 8,474,197 | B2 | 7/2013 | Bennett et al. | |
| 8,511,043 | B2 | 8/2013 | Fyfe | |
| 2002/0038687 | A1 | 4/2002 | Anderson et al. | |
| 2002/0069600 | A1 | 6/2002 | Bryant | |
| 2002/0108342 | A1 | 8/2002 | Henits | |
| 2002/0139059 | A1 | 10/2002 | Zimmerman | |
| 2002/0144482 | A1 | 10/2002 | Henson et al. | |
| 2002/0176749 | A1 | 11/2002 | Provost | |
| 2002/0182955 | A1 | 12/2002 | Weglewski et al. | |
| 2003/0003258 | A1 | 1/2003 | Durso et al. | |
| 2003/0087572 | A1 | 5/2003 | Balthes et al. | |
| 2003/0089061 | A1 * | 5/2003 | DeFord et al. | 52/309.9 |
| 2003/0145550 | A1 | 8/2003 | Bennett et al. | |
| 2003/0182886 | A1 | 10/2003 | Parrish | |
| 2004/0040234 | A1 | 3/2004 | Davison et al. | |
| 2004/0103601 | A1 | 6/2004 | Bergqvist | |
| 2004/0144040 | A1 | 7/2004 | Fulford et al. | |
| 2004/0211144 | A1 | 10/2004 | Stanchfield | |
| 2005/0064128 | A1 | 3/2005 | Lane et al. | |
| 2005/0126699 | A1 | 6/2005 | Yen et al. | |
| 2005/0138891 | A1 * | 6/2005 | Wool et al. | 52/782.1 |
| 2005/0167027 | A1 | 8/2005 | Lane | |
| 2005/0229504 | A1 | 10/2005 | Bennett et al. | |
| 2006/0096205 | A1 * | 5/2006 | Griffin et al. | 52/309.4 |
| 2006/0185305 | A1 | 8/2006 | Schaffer | |
| 2006/0225836 | A1 | 10/2006 | LeFevre et al. | |
| 2007/0022707 | A1 | 2/2007 | Gregg et al. | |
| 2007/0025588 | A1 | 2/2007 | Bachmann et al. | |
| 2007/0125042 | A1 | 6/2007 | Hughes et al. | |
| 2008/0041013 | A1 | 2/2008 | Vetesnik et al. | |
| 2008/0124576 | A1 | 5/2008 | Elliott | |
| 2008/0236058 | A1 | 10/2008 | Antonie | |
| 2009/0004423 | A1 | 1/2009 | Dietz | |
| 2009/0255204 | A1 | 10/2009 | Schwartau | |
| 2009/0255213 | A1 | 10/2009 | Schwartau | |
| 2009/0282777 | A1 | 11/2009 | Schwartau | |
| 2009/0293396 | A1 | 12/2009 | Porter | |
| 2009/0307995 | A1 | 12/2009 | Schwartau | |
| 2009/0313926 | A1 | 12/2009 | Schwartau | |
| 2009/0320387 | A1 | 12/2009 | Schwartau | |
| 2010/0005732 | A1 | 1/2010 | Schwartau | |
| 2010/0050542 | A1 | 3/2010 | Schwartau | |
| 2010/0050549 | A1 | 3/2010 | Schwartau | |
| 2010/0050553 | A1 | 3/2010 | Schofield | |

FOREIGN PATENT DOCUMENTS

| | | | |
|---|---|---|---|
| DE | 39 01 237 | A1 | 7/1990 |
| DE | 197 15 529 | C1 | 8/1998 |
| DE | 103 02 869 | B3 | 6/2004 |
| DE | 10 2005 054 608 | B3 | 3/2007 |
| DE | 20 2006 004 153 | U1 | 8/2007 |
| DE | 10 2006 018 110 | A1 | 9/2007 |
| DE | 20 2006 004 646 | U1 | 9/2007 |
| DE | 20 2006 004 985 | U1 | 9/2007 |
| EP | 0105411 | A | 4/1984 |
| EP | 0 249 592 | A2 | 12/1987 |
| EP | 0438766 | A | 7/1991 |
| EP | 0478033 | A | 4/1992 |
| EP | 0 843 054 | A2 | 5/1998 |
| EP | 1 393 892 | A | 3/2004 |
| FR | 2 154 655 | A | 5/1973 |
| FR | 2 831 229 | A1 | 4/2003 |
| GB | 559 527 | A | 2/1944 |

(56) References Cited

FOREIGN PATENT DOCUMENTS

| | | | |
|---|---|---|---|
| GB | 1375877 | A | 11/1974 |
| GB | 2225 282 | A | 5/1990 |
| GB | 2 399 539 | A | 9/2004 |
| SE | 461076 | B | 1/1990 |
| WO | WO 84/04727 | A | 12/1984 |
| WO | 85/02895 | A1 | 7/1985 |
| WO | 01/19603 | A1 | 3/2001 |
| WO | 01/59311 | A1 | 8/2001 |
| WO | 02/04876 | A1 | 5/2002 |
| WO | 02/40876 | A1 | 5/2002 |
| WO | WO 2007/104577 | A1 | 9/2007 |
| WO | WO 2007/107376 | A1 | 9/2007 |
| WO | WO 2007/110223 | A1 | 10/2007 |
| WO | WO 2007/121899 | A1 | 11/2007 |
| WO | 2009/125289 | A2 | 10/2009 |
| WO | 2009/125291 | A2 | 10/2009 |

OTHER PUBLICATIONS

International Search Report Corresponding to PCT/EP2007/002684, mailed Aug. 7, 2007.
International Search Report Corresponding to PCT/EP2007/003379, mailed Jul. 24, 2007.
Ulrich Schwartau, Straight Joint for Sandwich Panels and Method of Fabricating Same, U.S. Appl. No. 12/101,620, filed Apr. 11, 2008.
Ulrich Schwartau, Straight Panel With Closed Edge and Methods of Fabricating, U.S. Appl. No. 12/101,646, filed Apr. 11, 2008.
Ulrich Schwartau, Angle Joint for Sandwich Panels and Method of Fabricating Same, U.S. Appl. No. 12/119,671, filed May 13, 2008.
Ulrich Schwartau, Roof Construction Joints Made of Sandwich Panels, U.S. Appl. No. 12/138,572, filed Jun. 13, 2008.
Ulrich Schwartau, Sandwich Panel Ground Anchor and Ground Preparation for Sandwich Panel Structures, U.S. Appl. No. 12/147,795, filed Jun. 27, 2008.
Ulrich Schwartau, Connection for Sandwich Panel and Foundation, U.S. Appl. No. 12/142,865, filed Jun. 20, 2008.
Ulrich Schwartau, Joint of Parallel Sandwich Panels, U.S. Appl. No. 12/201,285, filed Aug. 29, 2008.
Ulrich Schwartau, System and Method of Forming At Least a Portion of a Reinforced Roof Structure From Sandwich Panels, U.S. Appl. No. 12/204,576, filed Sep. 4, 2008.
Ulrich Schwartau, A Sandwich Panel Joint and Method of Joining Sandwich Panels, U.S. Appl. No. 12/201,687, filed Aug. 29, 2008.
International Search Report corresponding to PCT/EP2007/002350, mailed Jul. 13, 2007.
International Search Report and Written Opinion corresponding to PCT/IB2009/005223, mailed Feb. 9, 2010.
International Preliminary Report on Patentability corresponding to PCT/IB2009/005223, mailed Feb. 9, 2010.
International Search Report and Written Opinion corresponding to PCT/IB2009/005230, mailed Jul. 27, 2010.
International Preliminary Report on Patentability corresponding to PCT/IB2009/005230, mailed Jul. 27, 2010.
Ulrich Schwartau, "Multiple Panel Beams and Methods", U.S. Appl. No. 13/804,471, filed Mar. 14, 2013.
Ulrich Schwartau, "Multiple Panel Column and Methods", U.S. Appl. No. 13/804,777, filed Mar. 14, 2013.
Ulrich Schwartau, "Composite Sandwich Panels and Method of Forming Round Corners in Composite Sandwich Panels", U.S. Appl. No. 13/804,834, filed Mar. 14, 2013.
Ulrich Schwartau, "Columnar Structural Component and Method of Forming", U.S. Appl. No. 13/804,904, filed Mar. 14, 2013.
Ulrich Schwartau, "Columnar Structural Component and Method of Forming", U.S. Appl. No. 13/804,628, filed Mar. 14, 2013.
Ulrich Schwartau, "Ceiling Support Construction and Methods", U.S. Appl. No. 13/804,964, filed Mar. 14, 2013.
Ulrich Schwartau, "Nozzle System and Method for Manufacturing Composite Sandwich Panels", U.S. Appl. No. 13/826,025, filed Mar. 14, 2013.
Ulrich Schwartau, "System and Method for Using an Acetone Solvent to Clean Manufacturing Equipment Used to Manufacture Composite Sandwich Panels", U.S. Appl. No. 13/826,094, filed Mar. 14, 2013.
Ulrich Schwartau, "Apparatus and Method for Producing a Multi-Axis Laminate", U.S. Appl. No. 13/826,169, filed Mar. 14, 2013.

* cited by examiner

BUILDING ROOF STRUCTURE HAVING A ROUND CORNER

TECHNICAL FIELD OF THE INVENTION

The present invention relates generally to constructing buildings, and more particularly, to forming a roof structure from one or more sandwich panels, wherein the roof structure has a round corner for defining a drainage area.

DESCRIPTION OF THE RELATED ART

There is an increasing demand for lower cost buildings such as houses, warehouses and office space. The demand for lower cost buildings is particularly strong in developing countries where economic resources may be limited and natural resources and raw materials may be scarce. For example, in areas of the Middle East or Africa, conventional building materials such as cement, brick, wood or steel may not be readily available or, if available, may be very expensive. In other areas of the world, poverty may make it too costly for people to build houses or other buildings with conventional materials.

The demand for low-cost housing also is high in areas afflicted by war or natural disasters, such as hurricanes, tornadoes, floods, and the like. These devastating events often lead to widespread destruction of large numbers of buildings and houses, especially when they occur in densely populated regions. The rebuilding of areas affected by these events can cause substantial strain on the supply chain for raw materials, making them difficult or even impossible to obtain. Furthermore, natural disasters often recur and affect the same areas. If a destroyed building is rebuilt using the same conventional materials, it stands to reason that the building may be destroyed or damaged again during a similar event.

It is generally desirable to increase speed of construction and to minimize construction costs. Prefabricated or preassembled components can streamline production and reduce both the time and the cost of building construction. Prefabricated buildings, however, are made from conventional materials and may be scarce or expensive to obtain. Thus, there exists a need for alternative materials and techniques for constructing buildings that use advanced material technologies to increase the speed of construction and also reduce or lower ownership costs.

SUMMARY

The present invention provides an alternative to conventional construction materials and techniques. Buildings, such as houses, commercial buildings, warehouses, or other structures can be constructed by composite sandwich panels, which have an insulative core and one or more outer layers. The buildings can be constructed by gluing or otherwise bonding several panels together, and usually screws, rivets, nails, etc., are not needed for such connections. Generally, composite sandwich panels offer a greater strength to weight ratio over traditional materials that are used by the building industry. The composite panels are generally as strong as, or stronger than, traditional materials including wood-based and steel-based structural insulation panels, while being lighter in weight. The composite sandwich panels also can be used to produce light-weight buildings, such as floating houses or other light-weight structures. Because they weigh less than traditional building materials, composite sandwich panels are generally less expensive to transport.

Sandwich panels generally are more elastic or flexible than conventional materials such as wood, concrete, steel or brick and, therefore, monolithic buildings made from sandwich panels are more durable than buildings made from conventional materials. For example, sandwich panels also may be non-flammable, waterproof and very strong and durable, and in some cases able to resist hurricane-force winds (up to 300 Kph (kilometers per hour)). The panels also may be resistant to the detrimental effects of algae, fungicides, water, and osmosis. As a result, buildings constructed from sandwich panels are better able to withstanding earthquakes, floods, tornadoes, hurricanes, fires and other natural disasters than buildings constructed from conventional materials.

A roof structure may be made with one or more sandwich panels having a round corner and installed with a drainage slope (e.g., a 5-10 degree slope) to facilitate removal of liquid (e.g., water, rain, snow, sleet, etc.) from the roof structure. The one or more sandwich panels that comprise the roof structure may be supported with a stiffener if desired. The round corner may have any desired curvature and/or angle for establishing a drainage area. The round corner may be formed in any desired manner. For example, the round corner may be formed by removing one or more portions of the sandwich panel in a predetermined manner to form a round corner. A force sufficient to bend a portion of the sandwich panel at the round corner joint may be applied. Bonding material may be applied to the areas of the sandwich panel with the removed portion or portions. The bonding material may be applied before and/or after the bending force is applied. The bonding material securely holds the round corner as desired. In another embodiment, a sandwich panel may have an end removed (e.g., by a miter cut) and a curved sandwich panel or other curved member may be bonded to the end of the sandwich panel having the removed end to form the round corner.

One aspect of the invention relates to a roof member used in forming at least a portion of a roof, the roof member including: at least one sandwich panel having a first outer layer and a second outer layer spaced from the first outer layer by a panel core, the sandwich panel further including a first end, a second end and a round corner between the first end and the second end, wherein the round corner includes a continuous first outer layer, a discontinuous second outer layer and a discontinuous portion of the panel core.

Another aspect of the invention relates to a method of forming a roof member having a round corner, the method including: providing at least one sandwich panel having a first outer layer and a second outer layer spaced from the first outer layer by a panel core, wherein the sandwich panel includes a first end and a second end; forming a round corner between the first end and the second end; and securing the at least one sandwich panel above at least one external wall of an associated structure, wherein the round corner extends beyond an outer surface of the at least one external wall.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto.

It should be emphasized that the term "comprises/comprising" when used in this specification is taken to specify the presence of stated features, integers, steps or components but does not preclude the presence or addition of one or more other features, integers, steps, components or groups thereof.

Features that are described and/or illustrated with respect to one embodiment may be used in the same way or in a similar way in one or more other embodiments and/or in combination with, or instead of, the features of the other embodiments.

DETAILED DESCRIPTION OF EMBODIMENTS

Figure 1:
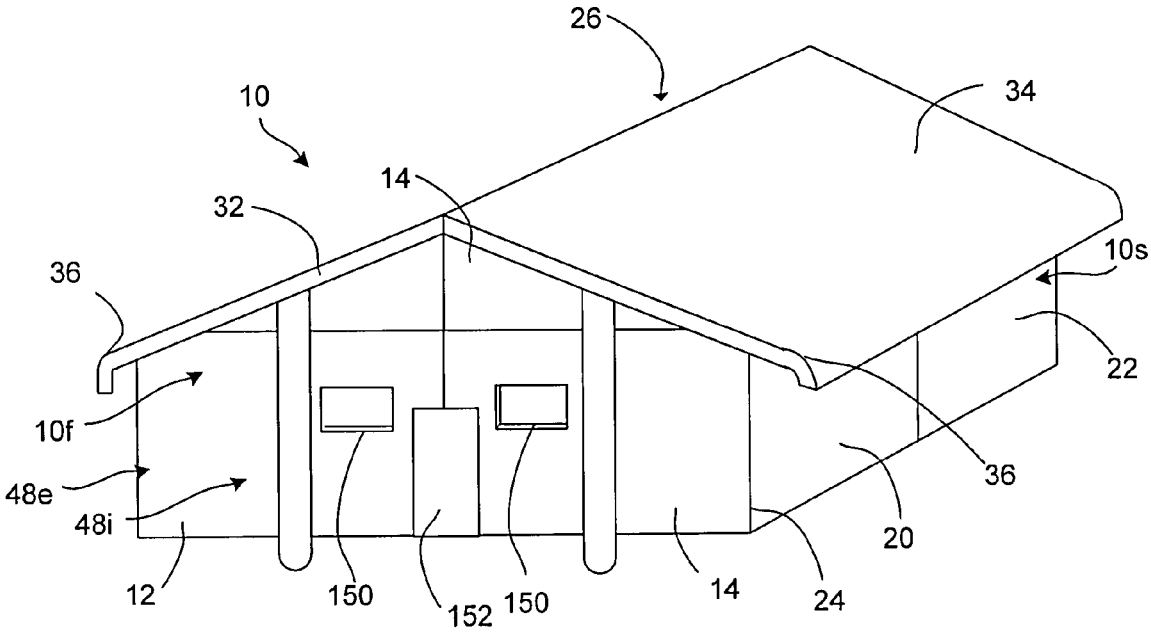
FIG. 1 is an environmental view of an exemplary monolithic structure built from composite materials.

In the detailed description that follows, like components have been given the same reference numerals regardless of whether they are shown in different embodiments of the invention. To illustrate the present invention in a clear and concise manner, the drawings may not necessarily be to scale and certain features may be shown in somewhat schematic form. Certain terminology is used herein to describe the different embodiments of the invention. Such terminology is used only for convenience when referring to the figures. For example, "upward," "downward," "above," or "below" merely describe directions in the configurations shown in the figures. The components can be oriented in any direction and the terminology should therefore be interpreted to include such variations. Furthermore, while described primarily with respect to house construction, it will be appreciated that all of the concepts described herein are equally applicable to the construction of any type building, such as warehouses, commercial buildings, factories, apartments, etc.

The structures described herein are built with composite materials, such as sandwich panels. Sandwich panels, which may be formed from synthetic materials, provide a light-weight and less expensive alternative to conventional raw materials, e.g., wood, concrete, metal, etc. Sandwich panels are usually connected or joined together with a high-strength bonding material, such as epoxy or glue, and conventional materials, such as nails and screws, are not usually needed. The result is a strong and durable monolithic (e.g., single unit) structure, as described further below. As set forth herein, a roof structure may be made with a composite sandwich panel that is installed with a 5 to 10 degree slope for drainage for rain. The roof panel can be supported with a stiffener if desired. Generally, at the end of the slope of the roof panel, the roof panel may be cut and bent to a 90 degree corner to shape a drainage area. Panel edges associated with the roof structure should be closed to moisture. Joints between roof panels (or elements) may be bridged with a laminate strip on the outside. The roof panel may be secured to the external wall with a bonding material (e.g., a glue line). Likewise, the round corner of the roof panel also may be secured by a bonding material (e.g., a glue line).

Referring to FIG. 1, an exemplary monolithic structure 10, for example, a house is built from a number of sandwich panels that are connected together with bonding material. The house 10 includes of a front wall 10*f* formed from sandwich panels 12, 14, 16, 18, a side wall 10*s* formed from sandwich panels 20, 22, and a roof structure 26. The front wall 10*f* and side wall 10*s* are connected to one another at a corner 24 of the house 10. Although not shown in FIG. 1, it will be appreciated that the house 10 may include a number of other walls, e.g., another side wall, a rear wall, internal walls, etc.

The roof structure 26 includes at least two sandwich panels 32 and 34. The sandwich panels 32, 34 include a round corner 36 for routing liquid and/or material that accumulate on the roof to a drainage area (e.g., ground adjacent the house 10, sewer, etc.). The details associated with construction and use of sandwich panels having round corners are discussed below.

Figure 2:
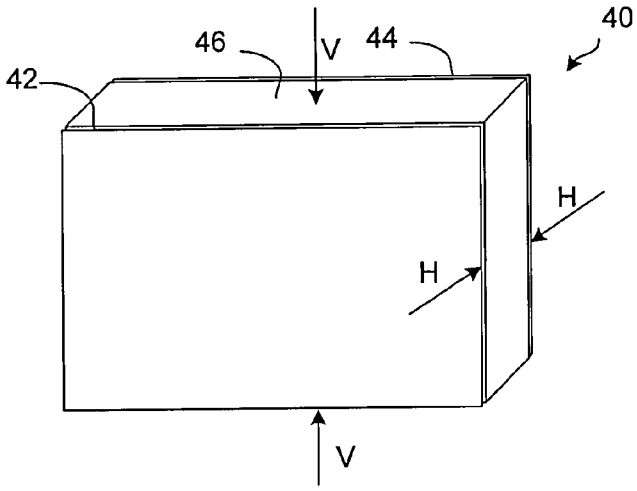
FIG. 2 is an isometric view of an exemplary sandwich panel.

An exemplary sandwich panel 40 is illustrated in FIG. 2. As used herein, the phrase "sandwich panel" means a panel having two outer layers 42, 44 separated by a core 46. The outer layers 42, 44 of the sandwich panel 40 are made from a composite material that includes a matrix material and a filler or reinforcement material. Exemplary matrix materials include a resin or mixture of resins, e.g., epoxy resin, polyester resin, vinyl ester resin, natural (or non oil-based) resin or phenolic resin, etc. Exemplary filler or reinforcement materials include fiberglass, glass fabric, carbon fiber, or aramid fiber, etc. Other filler or reinforcement materials include, for example, one or more natural fibers, such as, jute, coco, hemp, or elephant grass, balsa wood, or bamboo.

The outer layers 42, 44 (also referred to as laminates) may be relatively thin with respect to the panel core 46. The outer layers 42, 44 may be several millimeters thick and may, for example, be between about 1 mm (millimeter)-12 mm (millimeters) thick; however, it will be appreciated that the outer layers can be thinner than 1 mm (millimeter) or thicker than 12 mm (millimeters) as may be desired. In one embodiment, the outer layers are about 1-3 mm (millimeters) thick.

It will be appreciated that the outer layers 42, 44 may be made thicker by layering several layers of reinforcement material on top of one another. The thickness of the reinforcement material also may be varied to obtain thicker outer layers 42, 44 with a single layer of reinforcement material. Further, different reinforcement materials may be thicker than others and may be selected based upon the desired thickness of the outer layers.

The panel core 46 separates the outer layers 42, 44 of the sandwich panel 40. The panel core 46 may be formed from a light-weight, insulative material, for example, polyurethane, expanded polystyrene, polystyrene hard foam, Styrofoam® material, phenol foam, a natural foam, for example, foams made from cellulose materials, such as a cellulosic corn-based foam, or a combination of several different materials. Other exemplary panel core materials include honeycomb that can be made of polypropylene, non-flammable impregnated paper or other composite materials. It will be appreciated that these materials insulate the interior of the structure and also reduce the sound or noise transmitted through the panels, e.g., from one outer surface to the other or from an exterior 48*e* to an interior 48*i* of the building, etc. The core 46 may be any desired thickness and may be, for example, 30 mm (millimeters)-100 mm (millimeters) thick; however, it will be appreciated that the core can be thinner than 30 mm (millimeters) or thicker than 100 mm (millimeters) as may be desired. In one embodiment, the core is approximately 40 mm (millimeters) thick.

The outer layers 42, 44 are adhered to the core 46 with the matrix materials, such as the resin mixture. Once cured, the outer layers 42, 44 of the sandwich panel 40 are firmly adhered to both sides of the panel core 46, forming a rigid building element. It will be appreciated that the resin mixture also may include additional agents, such as, for example, flame retardants, mold suppressants, curing agents, hardeners, etc. Coatings may be applied to the outer layers 42, 44, such as, for example, finish coats, paint, etc.

The core 46 may provide good thermal insulation properties and structural properties. The outer layers 42, 44 may add to those properties of the core and also may protect the core 46 from damage. The outer layers 42, 44 also may provide rigidity and support to the sandwich panel 40.

The sandwich panels may be any shape and size. In one embodiment, the sandwich panels are rectangular in shape and may be several meters, or more, in height and width. The sandwich panels also may be other shapes and sizes. The combination of the core 46 and outer layers 42, 44 create sandwich panels with high ultimate strength, which is the maximum stress the panels can withstand, and high tensile strength, which is the maximum amount of tensile stress that the panels can withstand before failure. The compressive strength of the panels is such that the panels may be used as both load bearing and non-load bearing walls. In one embodiment, the panels have a load capacity of at least 50 tons per square meter in the vertical direction (indicated by arrows V in FIG. 2) and 2 tons per square meter in the horizontal direction (indicated by arrows H in FIG. 2). The sandwich panels may have other strength characteristics as will be appreciated in the art.

Internal stiffeners may be integrated into the panel core 46 to increase the overall stiffness of the sandwich panel 40. In one embodiment, the stiffeners are made from materials having the same thermal expansion properties as the materials used to construct the panel, such that the stiffeners expand and contract with the rest of the panel when the panel is heated or cooled.

The stiffeners may be made from the same material used to construct the outer layers of the panel. The stiffeners may be made from composite materials and may be placed perpendicular to the top and bottom of the panels and spaced, for example, at distances of 15 cm (centimeters), 25 cm, 50 cm, or 100 cm. Alternatively, the stiffeners may be placed at different angles, such as a 45-degree angle with respect to the top and bottom of the panel, or at another angle, as may be desired.

Figure 3:
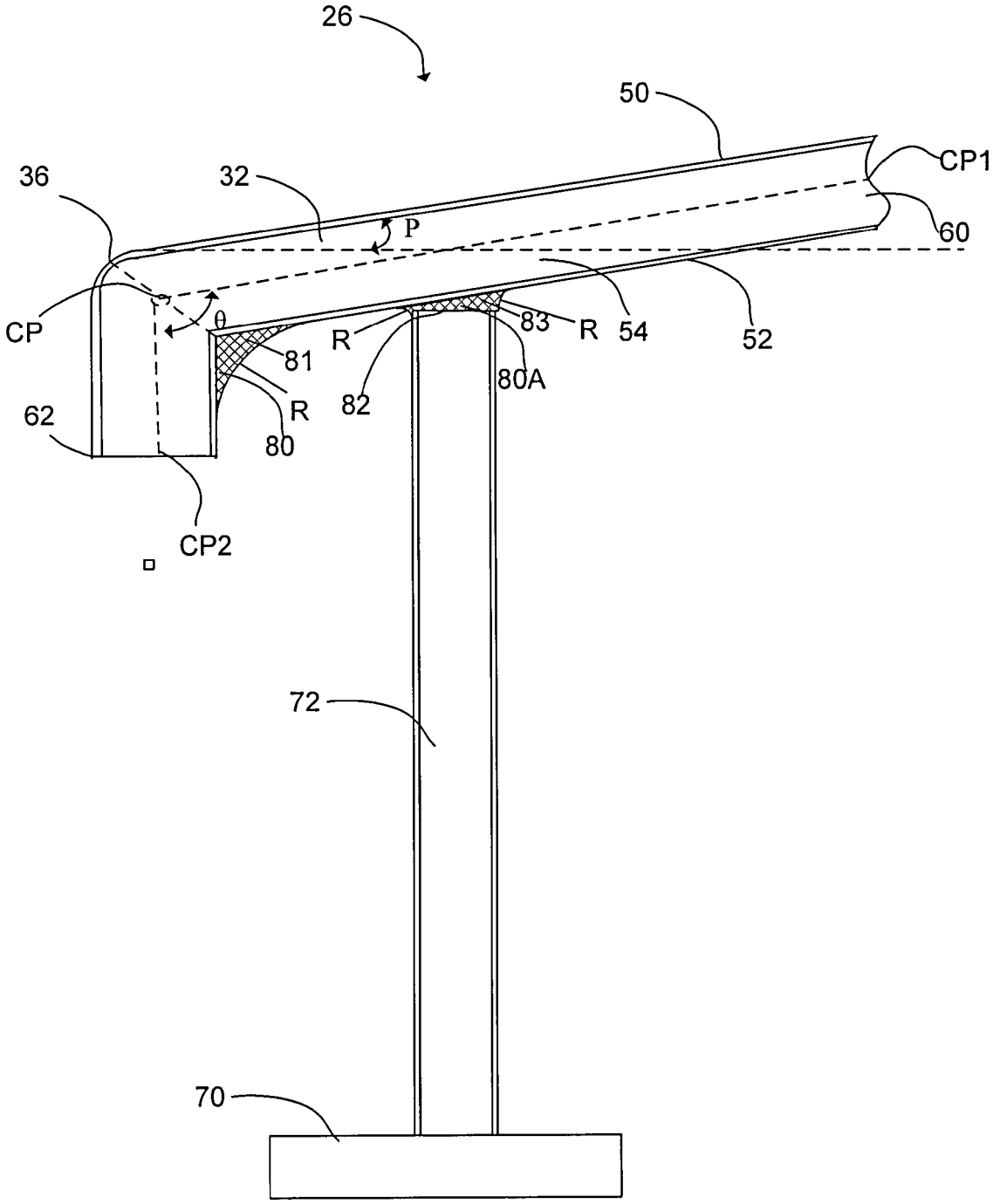
FIG. 3 is a front cross-sectional view of an exemplary roofing structure in accordance with aspects of the present invention.
Figure 4:
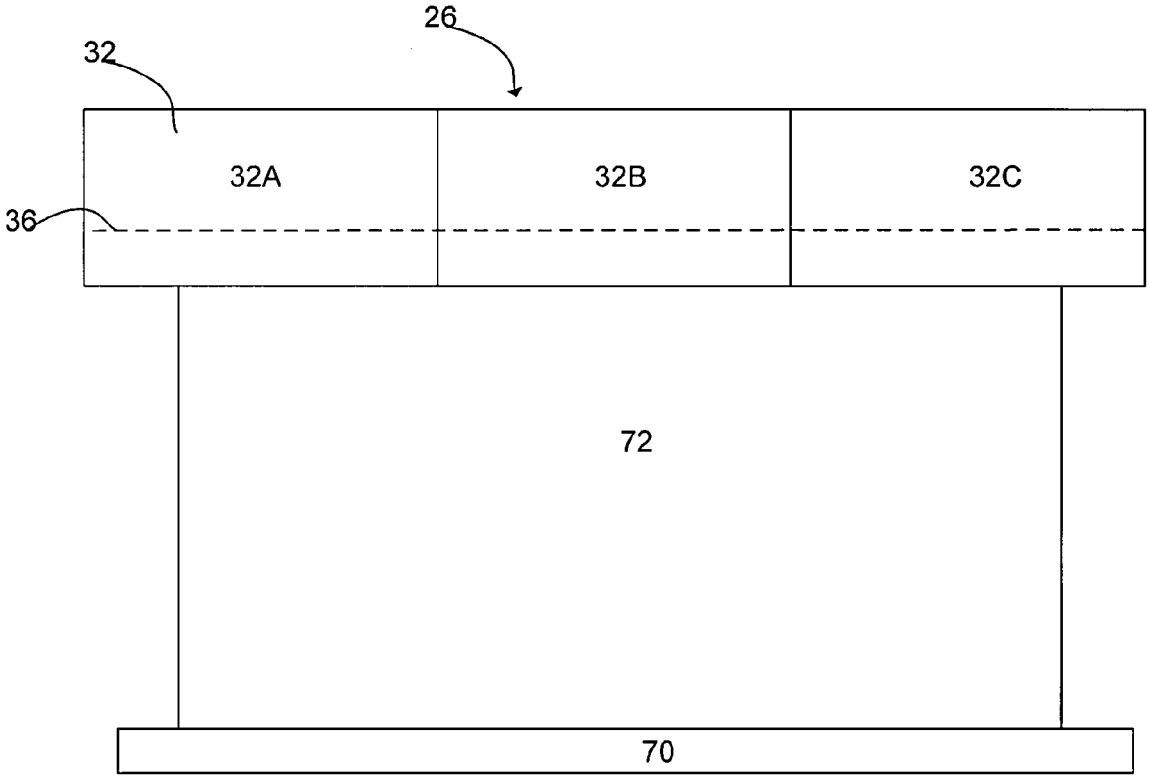
FIG. 4 is a side cross-sectional view of the exemplary roofing joint of FIG. 3 in accordance with aspects of the present invention.
Figure 5A:
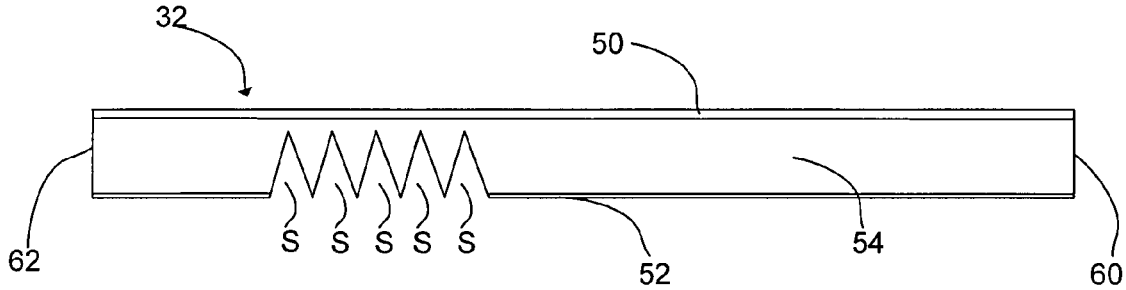
FIGS. 5A and 5B are side cross-sectional views of an exemplary sandwich panel having a round corner formed therein in accordance with aspects of the present invention.
Figure 5B:
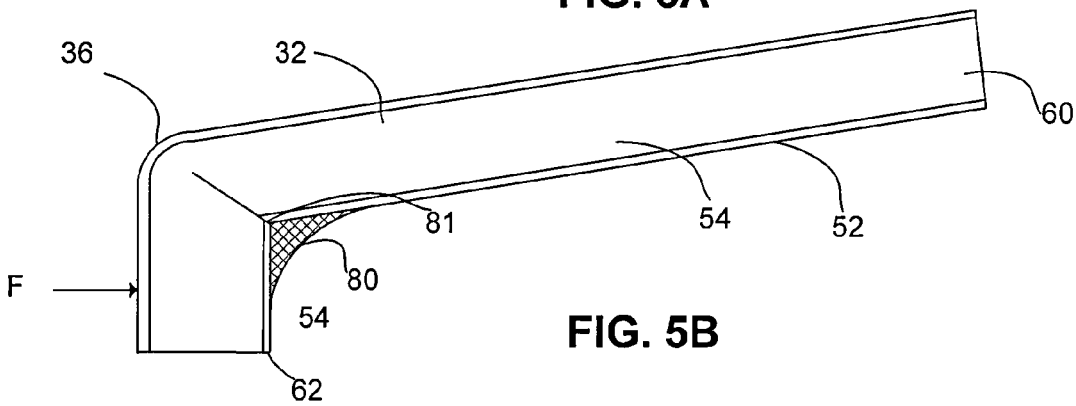

Referring to FIGS. 3 and 4, one or more sandwich panels (e.g., sandwich panel 32, 32A, 32B, 32C) having a round corner 36 may be used to form at least a portion of the roof structure 26. The above description of the exemplary sandwich panel 40 also is applicable to sandwich panels 32, 34. The round corner 36 may be imparted during the manufacturing process and/or during the installation process. In addition, the round corner 36 of the sandwich panels may be imparted by any desired manner. For example, the round corner 36 may be molded integrally as part of the sandwich panel; the round corner may be imparted by bending the sandwich panel; the round corner may be imparted by miter cutting an end of the sandwich panel and bonding a formed rounded edge onto the cut edge of the sandwich panel. In addition, referring to FIGS. 5A and 5B, the round corner may be imparted by removing one or more sections (S) of the sandwich panel 32 along the interior of the round corner to be formed. For example, portions of the second outer layer 52 and/or panel core 54 may be removed to allow the sandwich panel to be configured easily. It is generally desirable to maintain a continuous first outer layer 50 in order to facilitate liquid flow on the roof structure 26. A force (F) may be applied to bend the end to the desired position and using a bonding material 80 to secure the shape of the round corner (as shown in FIGS. 5A, 5B), etc. A bonding material 80 may be used to secure the shape of the round corner 36 (e.g., secure the round corner to a predetermined shape) and prevent moisture from entering the underside of the round corner junction (e.g., prevent moisture from entering the interface 81 between the second outer layer 52 and to panel core layer 54). The bonding material 80 is discussed in detail below.

Figure 6:
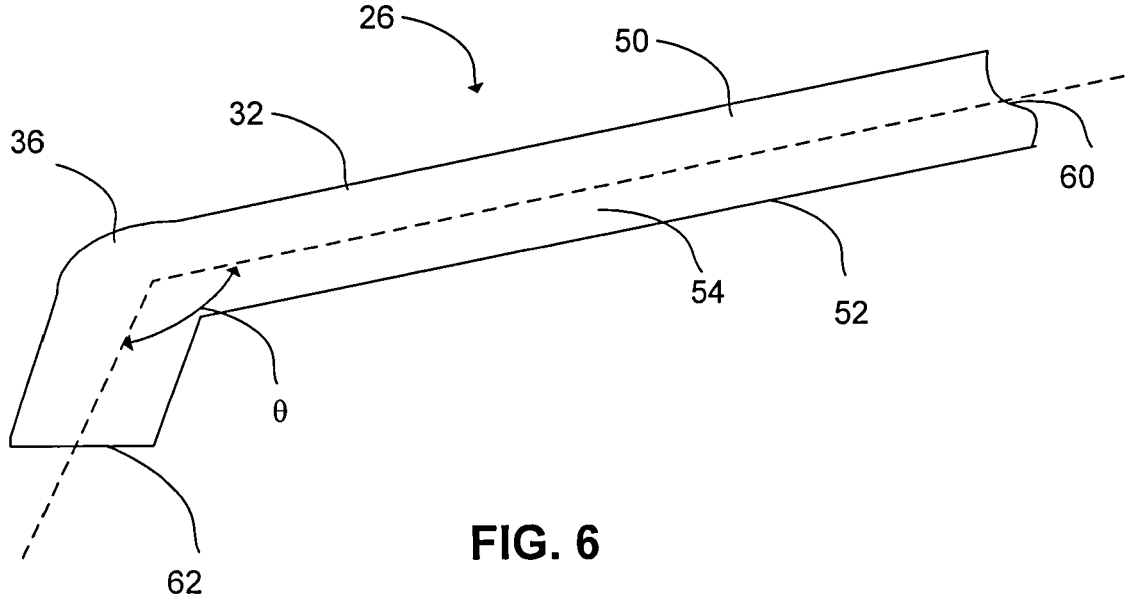
FIGS. 6 and 7 are exemplary sandwich panels having a round corner formed therein in accordance with aspects of the present invention.
Figure 7:
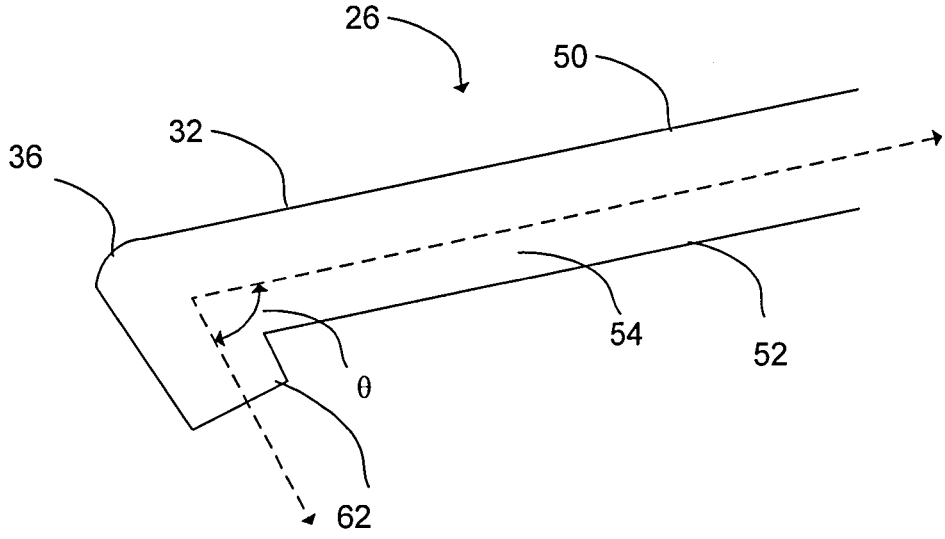

Like the exemplary sandwich panel 40 discussed above, the sandwich panel 32 has a first outer layer 50 and a second outer layer 52 spaced apart from each other by a panel core 54, as illustrated in FIG. 3. The sandwich panel 32 includes a first end 60 and a second end 62. The round corner 36 is formed between the first end 60 and the second end 62. The round corner 36 may be formed have any desired angle θ (FIG. 3) and/or curvature. The angle θ may be measured from a center point (CP) of the round corner and the center point (CP1) of the first end 60 (also referred herein as a first axis) and center point (CP2) of the second end 62 (also referred herein as a second axis). As shown in FIG. 3, the round corner 36 may be substantially perpendicular, as measured between the first axis and the second axis. In another embodiment, the round corner 36 may form an obtuse angle θ, as illustrated in FIG. 6. In another embodiment, round corner 36 may form an acute angle θ, as illustrated in FIG. 7.

It is desirable for the roof structure 26 to have a pitch to facilitate removal of water, rain, snow, sleet, etc. from the roof structure 26. In one embodiment, the pitch (P) of the roof is less than 20 degrees. In another embodiment, the pitch (P) of the roof is less than about 10 degrees. In yet another embodiment, the pitch (P) of the roof is between about 5 degrees and about 10 degrees. As illustrated in FIG. 3, the pitch (P) is measured from a planar surface of the sandwich panel (e.g., first outer layer 50) relative to a ground plane and/or a base 70 associated with the structure (e.g., the base 70 may be any structure that supports one more exterior walls (e.g., exterior wall 72 (FIG. 3)). The sandwich panel 32 may be supported in any manner to obtain the desired roof pitch. For example, the sandwich panel 32 may be secured to one or more exterior walls (e.g., exterior wall 72) and/or interior walls and/or any other support structure. As shown in FIG. 3, the height of the first end 60 is elevated above a height of the round corner 36 and the second end 62. Such a configuration facilitates removal liquid and materials from the roof structure 26.

The sandwich panel 32 may be secured to the exterior wall 72 by a bonding material 80A. As shown in FIG. 3, the bonding material 80A may be applied between the second outer layer 52 of the sandwich panel 32 and the top 82 of the exterior wall 72.

The round corner 36 generally extends past the exterior wall 72 in order to facilitate removal of liquid (e.g., water, rain, snow, etc.) from the roof structure 26 and to protect the outside wall from such liquid. In addition, it is desirable for the first outer layer 50 of the sandwich panels that comprise the roof structure 26 to have a continuous outer surface throughout the roof structure 26 at the portion of the sandwich panels that form the round corner 36. Generally, gravitational forces and the pitch (P) of the roof will cause the liquid or other materials on the roof structure 26 to fall or move down the round corner 36 towards the second end 62 of the sandwich panel. The liquid and/or materials will flow or otherwise move off round corner 36 and the first outer surface 50 near the first end 60 to a drainage area. The drainage area may be any suitable drainage area (e.g., sewer, ground surrounding structure 10, etc.) for receiving the liquid and/or material.

The interface 83 between the second outer layer 52 and the exterior wall 72 may be sealed by applying bonding material 80A within the interface and/or along the interface. The bonding material 80A rigidly holds or connects the sandwich panel 32 to the exterior wall 72 and also may span across and seal the interface to prevent moisture from entering the interface 83.

The bonding material 80A may be applied in any desirable manner. For example, the bonding material may be applied by injection, spreading, spraying, molding, etc. The bonding material 80A rigidly holds or connects one or more sandwich panels (e.g., sandwich panels 32, 32A, 32B, 32C, 34, etc.) to the exterior wall 72. In addition the bonding material 80 may secure the round corner 36 formed in the sandwich panels that form the roof structure 26. The bonding material 80, 80A also prevents moisture from entering the interfaces 81, 83, which may have deleterious effects on the sandwich panels.

The bonding material 80, 80A may be curved, molded, or formed to create a round corner having a radius R, e.g., as shown in FIGS. 3 and 5. The round corner may distribute forces along one or more building elements. The length of the radius may be about 15 mm (millimeters)-40 mm (millimeters) in length. The length of the radius R may be selected based upon the thicknesses of the outer layers 50, 52 of the sandwich panels used to form the roofing structure 26 and/or exterior wall 72, according to a desired ratio. The desired ratio of the radius R to the thickness of the outer layers 50, 52 may be about seven to one (7:1), or more, e.g., 8:1 or an even larger ratio. For instance if the outer layers 50, 52 are about 2 mm (millimeters) thick, the radius R would be at least about 14 mm (millimeters), and may be thicker, if desired, or adjusted based upon a desired strength or other factor. In another example, the outer layers may be 3 mm (millimeters) thick and the radius R is at least about 21 mm (millimeters) or more.

The bonding material 80, 80A may be any suitable bonding material such as epoxy, epoxy resin, glue, adhesive, adhering material or another bonding material (these terms may be used interchangeably and equivalently herein).

The bonding material used to connect the exterior wall 77 with the sandwich panel 32 and seal and/or secure the round corner 36 has the same general thermal expansion characteristics as the materials used to construct the sandwich panel. In one embodiment, the bonding material is more flexible or bendable than the sandwich panels, and may, for example, be four or five times more flexible than the panels. The flexibility of the bonding material, therefore, reduces the likelihood that the joints (e.g., interfaces 81, 83) of the monolithic structure will break or split, and also transmits loads from one panel to another, across the joint. The bonding material may include filling components, such as, fiberglass or a fiberglass and resin mixture, and may, for example, be microfiber and Aerosil®.

Referring back to FIG. 1, the sandwich panels may be customized by cutting and removing a portion of the panel 12, 14 to form an opening for a window 150. The window opening 150 may be cut to any desired size to accommodate the installation of any size window. Similarly, a portion of the panel 12 may be cut and removed to form an opening or doorway 152. Although the sandwich panels (e.g., 12, 14, 20, 22) of FIG. 1 are shown with window 150 and door 152 cutouts, it will be appreciated that the panel can be customized in any manner desired to meet the specifications of an architectural or design plan. For example, referring to FIG. 1, the panel 14 includes several window openings 150 and no door opening, while panels 20, 22 are solid walls. The sandwich panels also may be cut in other designs to accommodate other roof, wall, etc. arrangements. It also will be appreciated that while the windows, door and roof are described as being cut from a solid sandwich panel, the openings may be molded or otherwise formed in the panel.

Although the invention has been shown and described with respect to a certain preferred embodiment or embodiments, it is obvious that equivalent alterations and modifications will occur to others skilled in the art upon the reading and understanding of this specification and the annexed drawings.

What is claimed is:

1. A roof member used in forming at least a portion of a roof, the roof member comprising:

at least one sandwich panel having a first outer layer and a second outer layer spaced from the first outer layer by a panel core, the sandwich panel further including a first end, a second end and a round corner between the first end and the second end, wherein the round corner includes a continuous first outer layer, a discontinuous second outer layer and a discontinuous portion of the panel core, and a first bonding material forming a concave shape having an apex at a portion of the discontinuous second outer layer that forms the round corner.

2. The roof member of claim 1, wherein the sandwich panel is secured to at least one exterior wall of an associated structure at the second outer layer.

3. The roof member of claim 2, wherein a second bonding material is applied between the second outer layer and the at least one exterior wall of the associated structure.

4. The roof member of claim 2, wherein the first end is pitched above the round corner to facilitate movement of an associated liquid from the first end to the round corner.

5. The roof member of claim 4, wherein the first end is pitched at an angle relative to a base of the associated structure of less than approximately 20 degrees.

6. The roof member of claim 5, wherein the first end is pitched at an angle relative to the base of the associated structure of approximately 10 degrees.

7. The roof member of claim 1 further including a first axis extending from the first end and the round corner and a second axis extending from the second end and the round corner, wherein the first axis and the second axis are substantially perpendicular to each other.

8. The roof member of claim 1 further including a first axis extending from the first end and the round corner and a second axis extending from the second end and the round corner, wherein the first axis and the second axis form an obtuse angle.

9. The roof member of claim 1 further including a first axis extending from the first end and the round corner and a second axis extending from the second end and the round corner, wherein the first axis and the second axis forms an acute an angle.

10. A structure used in forming at least a portion of a building, the structure comprising:

at least one roof member sandwich panel having:

a panel core, a first outer layer, a second outer layer spaced from the first outer layer by the panel core, a first end, a second end, and a round corner between the first end and the second end, wherein the first outer layer is continuous at the round corner, the second outer layer is discontinuous at the round corner, and a portion of the panel core is discontinuous at the round corner;

a first bonding material forming a concave shape having an apex at a portion of the discontinuous second outer layer at the round corner;

at least one wall member sandwich panel having:

a panel core, a first outer layer, and a second outer layer spaced from the first outer layer by the panel core, and a second bonding material between the second outer layer of the at least one roof member sandwich panel and the at least one wall member sandwich panel, the second bonding material securing the second outer layer of the at least one roof member sandwich panel to the at least one wall member sandwich panel without an intervening connecting element.

11. The structure of claim 10, wherein the second bonding material forms a concave shape having an apex between a focal point of the concave shape and at least one of the at least one wall member sandwich panel and/or the at least one roof member sandwich panel.

12. The structure of claim 10, wherein the second bonding material is applied between the second outer layer of the at least one roof member sandwich panel and at least one of the first outer layer and/or the second outer layer of the at least one wall member sandwich panel.

13. The structure of claim 10, wherein the first bonding material forms a concave shape having an apex between a focal point of the concave shape and the at least one roof member sandwich panel.

* * * * *